US007618518B2

(12) United States Patent
Rata et al.

(10) Patent No.: US 7,618,518 B2
(45) Date of Patent: Nov. 17, 2009

(54) COMPOSITE DOCTOR ARRANGEMENT

(75) Inventors: Ilkka Rata, Jyväskylä (FI); Kalle Vaaraniemi, Tikkakoski (FI)

(73) Assignee: Metso Paper, Inc., Helsinki (FI)

( * ) Notice: Subject to any disclaimer, the term of this patent is extended or adjusted under 35 U.S.C. 154(b) by 522 days.

(21) Appl. No.: 11/423,094

(22) Filed: Jun. 8, 2006

(65) Prior Publication Data

US 2006/0289141 A1 Dec. 28, 2006

(30) Foreign Application Priority Data

Jun. 17, 2005 (FI) ..... 20055321

(51) Int. Cl.
*D21G 3/00* (2006.01)

(52) U.S. Cl. ..... 162/280; 118/413; 15/256.51

(58) Field of Classification Search ..... 162/280–281; 118/123, 126, 261, 410, 413; 15/256.51; 101/157, 350.6, 356, 425
See application file for complete search history.

(56) References Cited

U.S. PATENT DOCUMENTS

| | | | | |
|---|---|---|---|---|
| 2,732,773 | A * | 1/1956 | Smith | 15/256.51 |
| 4,367,120 | A | 1/1983 | Hendrikz | |
| 5,356,519 | A | 10/1994 | Grabscheid et al. | |
| 6,447,646 | B1 | 9/2002 | Hassinen et al. | |
| 6,758,904 | B2 * | 7/2004 | Parni et al. | 118/126 |
| 6,942,734 | B2 * | 9/2005 | Rata et al. | 118/123 |
| 2001/0011401 | A1 * | 8/2001 | Rata | 15/256.51 |
| 2004/0163587 | A1 * | 8/2004 | Rata | 118/123 |
| 2004/0237884 | A1 * | 12/2004 | Rata et al. | 118/123 |
| 2006/0180291 | A1 * | 8/2006 | Rata | 162/281 |
| 2006/0289141 | A1 * | 12/2006 | Rata et al. | 162/280 |

FOREIGN PATENT DOCUMENTS

| | | | |
|---|---|---|---|
| EP | 1734182 | A1 * | 12/2006 |
| EP | 1 734 182 | B1 | 5/2008 |
| FI | 911202 | | 6/1992 |
| FI | 105577 | B | 8/2000 |
| FI | 107399 | B | 7/2001 |
| FI | 111474 | B | 7/2003 |
| FI | 114328 | B | 9/2004 |
| JP | 4-240294 | A | 8/1992 |
| JP | 2001-254288 | A | 9/2001 |
| WO | 2004067839 | A1 | 8/2004 |

* cited by examiner

*Primary Examiner*—José A Fortuna

(57) ABSTRACT

A composite doctor arrangement for a web forming machine or web handling machine has a beam structure (10) with a mounting piece (13) fitted to it. A blade holder (11) is fitted to the mounting piece, with a blade (12) fitted to the blade holder (11). The mounting piece (13) is fitted axially and movably in the beam structure (10) by a form-locked mounting counter-piece (14), where the form locking is arranged so that it is fixed in the lateral direction of the blade (12) and essentially free in the longitudinal direction of the blade (12).

18 Claims, 3 Drawing Sheets

COMPOSITE DOCTOR ARRANGEMENT

CROSS REFERENCES TO RELATED APPLICATIONS

This application claims priority on Finnish Application No. FI 20055321, filed Jun. 17, 2005, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention concerns a composite doctor arrangement which is intended for a web forming machine or web handling machine and which has as components a beam structure, a mounting piece fastened to it, and a blade holder fastened to the mounting piece, with a blade included in the doctor arrangement fastened to the blade holder.

Doctor arrangements where the load-bearing element is a beam structure are used in web forming machines, such as in paper, board and tissue machines, and in web handling machines, such as in printing machines. The beam structure is usually supported on the web forming machine only by its ends. Beam lengths are currently up to more than 10 meters. Moreover, the speeds of web forming machines have increased clearly. When the beam structures are manufactured conventionally from metal, they become large and heavy. Hence, they require much installation space, and their own weight alone makes them deflect clearly. The said beam structures are also sensitive to vibration, which complicates the operation of the doctor arrangement.

In order to reduce weight and vibration and to speed up manufacture, beam structures are presently manufactured from materials lighter than metal. In this way, it is also possible to achieve increasingly light-weight but stiffer beam structures which feature better vibration properties than before. However, the composite construction calls for the use of expensive raw materials. Furthermore, it is problematic to join other parts included in the doctor arrangement to the beam structure. Especially the mounting piece intended for the blade holder must be fastened stationarily to the beam structure either with glue or a screw connection. In this case, for example the thermal expansion coefficient of the length of the mounting piece must be very close to that of the beam structure.

In practice, the manufacture of a sufficiently rigid beam structure requires the use of reinforcements such as carbon fiber reinforcements. In this case, the fixed mounting piece must also have corresponding reinforcements, for example, to avoid torsion resulting from differences between the ambient temperature and the temperature of the beam structure. Moreover, the mounting piece becomes large, which increases the manufacturing costs and complicates the placement of the mounting piece in the doctor arrangement. Further problems are caused by the fastening of commercially available blade holders to the composite mounting piece by means of screws. The blade holder is normally made of metal, or at least it has properties which differ from those of the mounting piece. This causes torsion and tension between the parts primarily due to differences in their thermal expansion coefficients. In other words, the manufacture of the doctor arrangement involves several limitations and problems, which add to the manufacturing costs and complicate the use of the doctor arrangement.

SUMMARY OF THE INVENTION

An objective of the present invention is to accomplish a new type of composite doctor arrangement which is more versatile than before and to which it is easy and simple to fasten various types of blade holders without extra limitations or tension. The characteristic features of the present invention will be more fully understood from the following description and drawings. In the doctor arrangement of the present invention, a rigid construction is achieved by the suitable dimensions and design of the parts without problems caused by thermal expansion. In other words, materials suitable for each purpose can be used in the manufacture of the parts, and the parts can be given the optimum dimensions. Moreover, existing parts can be used in the doctor arrangement without problems. Furthermore, the design can be used for improving the versatility of application, which adds to the variations of the doctor arrangement even almost without additional costs.

In the following, the invention is described in more detail with reference to the accompanying drawings describing some applications of the invention.

DESCRIPTION OF THE PREFERRED EMBODIMENTS

Figures 1A, 1B:
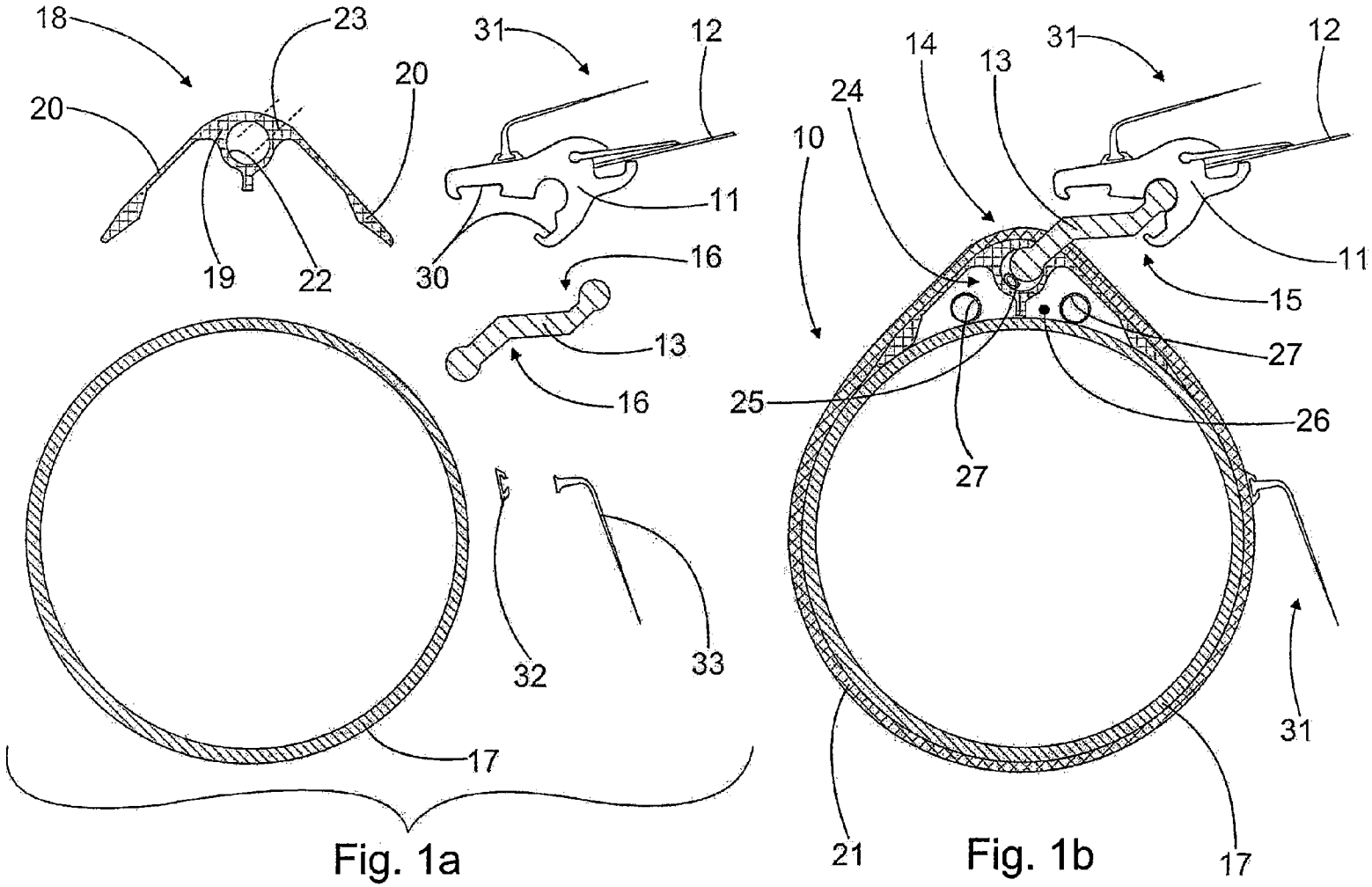
FIG. 1*a* illustrates a cross-sectional view of the detached parts of the doctor arrangement according to the invention.
FIG. 1*b* illustrates a doctor arrangement according to the invention composed of the parts of FIG. 1*a*.
Figure 3:
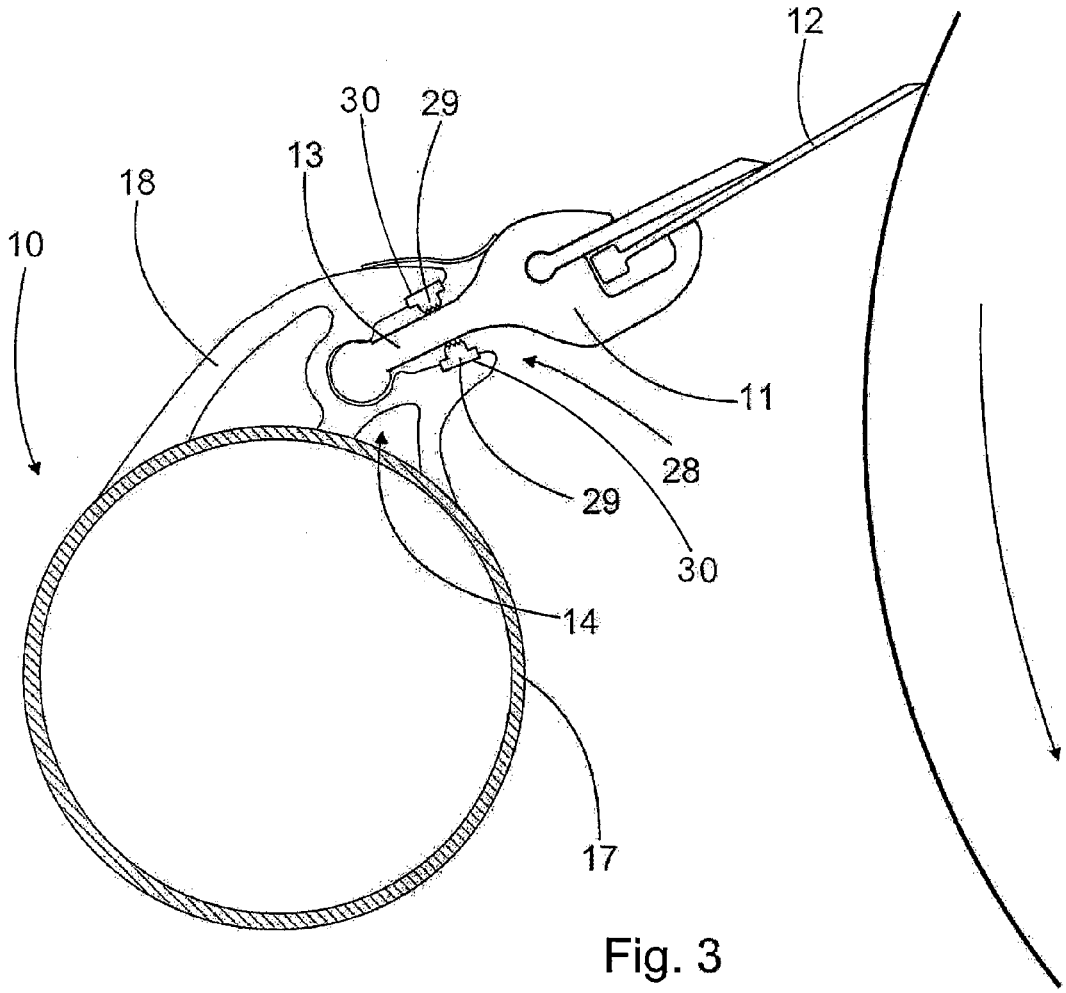
FIG. 3 illustrates a side view of another application of the doctor arrangement according to the invention.

FIGS. 1*a* and 1*b* illustrate one example of the doctor arrangement according to the invention and of its manufacture. The doctor arrangement is especially intended for use in conjunction with a web forming machine. In this case, the beam structure 10 included in the doctor arrangement is typically several meters long, presently up to more than 10 meters long. Moreover, the doctor arrangement comprises the blade holder 11, to which the blade 12 of the doctor arrangement is fastened. The same reference numbers have been used of parts with similar functions. The blade 12 doctors a moving surface, for example the surface of a revolving roll as shown in FIG. 3. The beam structure 10 also comprises the mounting piece 13 for the blade holder 11. According to the invention, the mounting piece 13 is fitted movably in axial direction in the beam structure 10 by means of a form-locked mounting counterpiece 14. This avoids the use of glue and screw connections, which have caused problems earlier. At the same time, the manufacture and service of the doctor arrangement are facilitated and expedited.

More exactly, the form locking is arranged so that it is fixed in the lateral direction of the blade 12 and essentially free in the longitudinal or axial direction of the blade 12. In this way, the necessary support forces are exerted from the beam structure 10 via the mounting piece 13 to the blade holder 11 and finally to the blade 12. However, due to the longitudinal free support of the blade 12, i.e. support in the cross direction of the web forming machine, the beam structure 10 and the mounting piece 13 can have different thermal expansion without tension or deflection created in the beam structure 10. Moreover, the floating mounting enables the manufacture of the mounting piece 13 from a less expensive material than the beam structure 10 and/or the use of reinforcements with different direction than in the beam structure 10. The dimensions and design of the mounting piece 13 are hence considerably freer while the costs still remain reasonable. The workability and quality of the entire doctor arrangement are still retained. In practice, the operation and reliability of the doctor arrangement according to the invention are better than before.

Figure 2B:
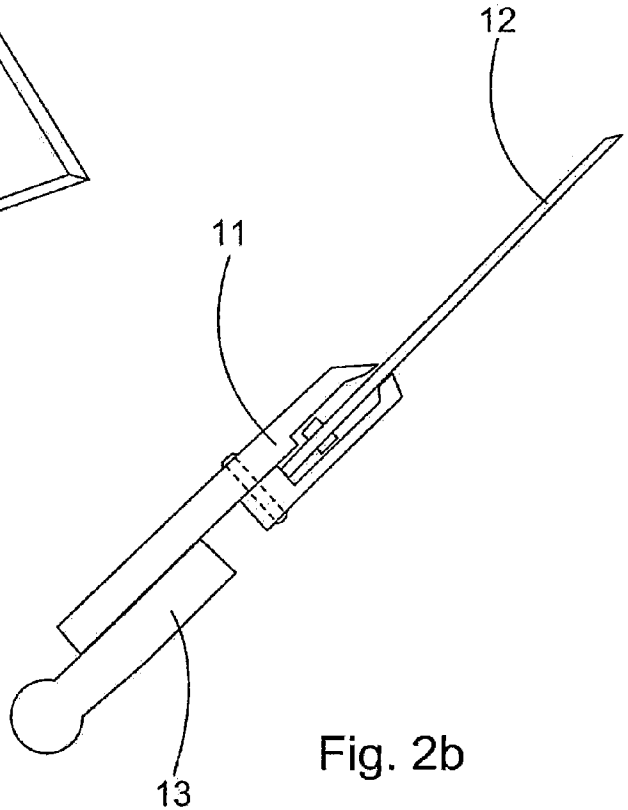
FIG. 2*b* illustrates a part of a variation of the doctor arrangement according to the invention.
Figure 2A:
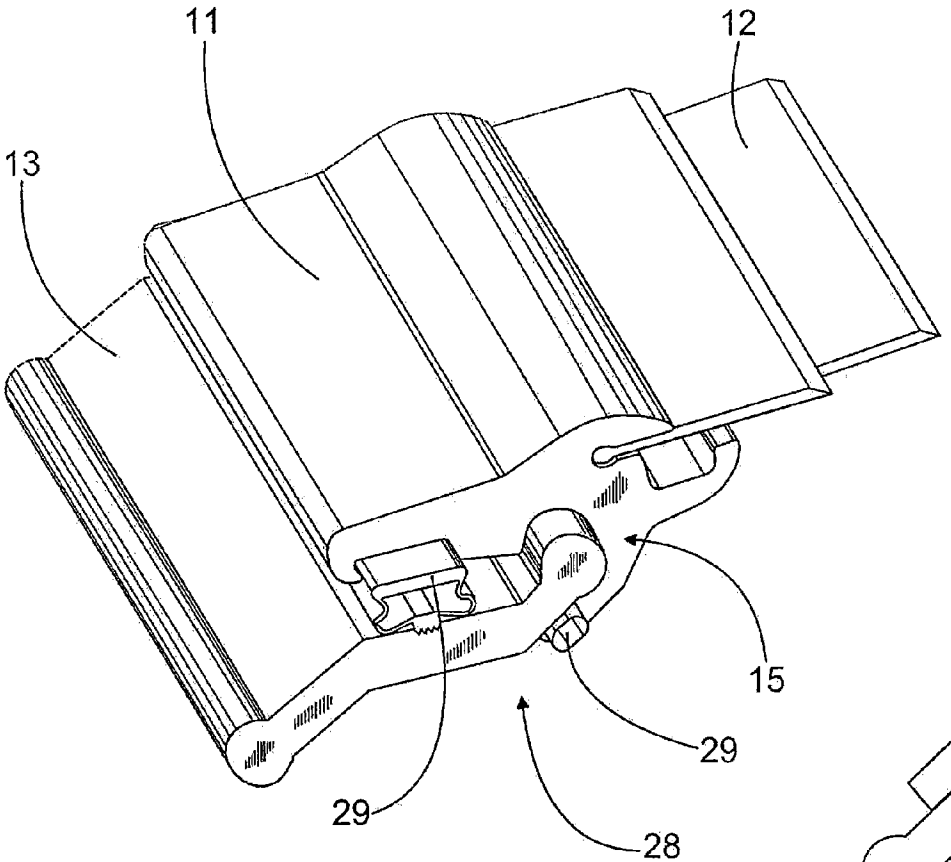
FIG. 2*a* illustrates an axonometric view of parts of the doctor arrangement in FIG. 1*b*.

A simple mounting piece 13 which is fastened to the beam structure 10 with a floating mounting is illustrated in FIG. 2*b*. The said mounting piece 13 can be manufactured easily, and almost any type of blade holder can be fastened to it, for example by means of screws or even by gluing. FIG. 2*a* illustrates a more advanced application than the one described above. In this application, the blade holder 11 is fastened to the mounting piece 13 with another form-locked mounting counterpiece 15. In other words, the doctor arrangement can have two form-locked mounting counterpieces so that thermal expansion problems between the parts can be avoided. In this way, the different parts can be manufactured so that they have different directions of reinforcement fibers, and they can even be manufactured from different materials. The mounting piece 13 is hence preferably of a different material than the beam structure 10. The different parts can also be dimensioned and designed optimally in view of their use and durability. Especially in the application illustrated in FIG. 2*a*, the service and modification of the doctor arrangement are particularly easy. The blade holder and the mounting piece can be replaced easily with other types simply by pulling the desired part out of the web forming machine laterally and by pushing a new part in its place. This feature can be utilized both in installing the doctor arrangement to the application used and in servicing the doctor arrangement.

The mounting piece 13 has a plate-like shape, which gives good reach with a small total weight. Furthermore, the edges corresponding to both mounting counterpieces 14 and 15 of the mounting piece 13 are essentially similar as shown in FIG. 1*b*. In this way, the mounting piece 13 can be placed in both ways in the doctor arrangement. Further variations can be achieved by arranging at least one fold 16 in the longitudinal direction of the blade 12 in the mounting piece 13. In this way, the location and position of the blade holder 11 and hence the location and position of the blade 12 with respect to the doctored surface can be changed by changing the mounting direction of the mounting piece 13. This enables the location of a single type of a doctor arrangement in different applications by simply changing the mounting piece 13 or only its position. In the application illustrated in FIG. 2*a*, there are two folds 16 in the mounting piece 13. It is easy to accomplish a fold in a plate-like mounting piece 13, although curved mounting pieces and mounting pieces with other shapes can also be used. Furthermore, many different shapes of mounting piece profiles can be manufactured in advance and of various materials, and the most suitable type can be selected for the application in question while installing the mounting piece.

The beam structure 10 according to the invention is preferably made of a composite material which gives a good relationship between weight and rigidity. In the simplest configuration, a prior art composite basic tube, for example a carbon fiber reinforced plastic tube, can be used in manufacture. Such a tube is illustrated, for example, in FIG. 1*a*. According to the invention, a separate profile piece 18 is also used, with the profile piece 18 fitted over the basic tube 17. Furthermore, a shape corresponding to the mounting piece 13 of the mounting counterpiece 14 has been arranged in the profile piece 18. In other words, the mounting piece 13 is fastened to the beam structure 10 by means of the shaped part of the profile piece 18. One profile piece 18 is illustrated in FIG. 1*a*. The profile piece 18 generally comprises a middle part 19 and side parts 20 on its each side. The side parts are at least partly flexible so that a single type of profile piece 18 can be used in conjunction with tubes with various diameters. The profile piece 18 is made of a plastic or composite material, and it is preferably glued onto the basic tube. One preferred material is glass fiber, which gives sufficient rigidity and durability at reasonable cost. In FIG. 1*b*, the profile piece 18 has been glued on the surface of the basic tube 17, and a coating layer 21 made of a composite material has been applied over them by winding. The coating layer together with the basic tube and the profile piece 18 hence forms a uniform and smooth beam structure, which has excellent load carrying capacity despite light weight. In beam structures which are loaded with a small load, no winding is necessarily needed.

The profile piece 18 is intentionally of a general model, and a uniform hollow 22 is located in its middle part 19. In principle, a slot 23, shown by broken lines in FIG. 1*a*, for the mounting piece 13 could be machined before winding. On the other hand, the possibility of incorrect positions is increased in this case, and the slot 23 needs to be reopened after winding. In practice, it is more preferable to open the slot 23 only after winding so that identical beam structures can be manufactured. In this case, the slot 23 is made according to the final position either outside the installation site or even after the beam structure 10 is fastened to the web forming machine. The deflection of the beam structure 10 can hence be taken into account, which reduces the deflection of the blade holder 11.

When suitable dimensions and machining are used, the form locking is almost free of clearances, and its sets into place at the latest when the doctor arrangement is loaded. However, tight tolerances may be problematic especially when servicing the doctor arrangement. According to the invention, the form locking is dimensioned loosely so that the parts can be fitted to each other easily even in difficult conditions. A loading element 24 can be arranged in the middle part 19 for locking the position of the mounting piece 13 with respect to the beam structure 10. The loading element 24 can be based on a certain construction or mechanism, or, as illustrated in FIG. 1*b*, on a loading hose 25. When installing or removing the mounting piece 13, the loading hose 25 is unpressurized so that the form locking opens in a way. Correspondingly, when the loading hose 25 is pressurized, the mounting piece 13 is wedged into the slot 23, which makes the form locking rigid and free of clearances. There can be one or more loading hoses. If necessary, the clearance can also be filled with a substance or even glue. On the other hand, the loading hose 25 can also be used for loading the doctor blade 12.

When the beam structure 10 is manufactured from the basic tube 17 and the profile piece 18, an empty space 26 remains between these, and medium connections 27 can be fitted in this space. There can be several medium connections 27, and they can be used, for example, for supplying compressed air in the doctor arrangement or for heating the beam structure 10. The empty space 26 can also be used as such as a channel with holes at suitable distances, not illustrated, for accomplishing a washing shower which keeps the beam structure 10 clean.

In the application illustrated in FIG. 2*a*, one of the mounting counterpieces also serves as a joint. In this case, loading elements 28 can be installed between the mounting piece 13 and the blade holder 11. In FIG. 2*a*, the loading elements 28 consist of two loading hoses 29. Instead, the so-called rigid blade holder 11 illustrated in FIG. 2*b* can be loaded by turning the entire beam structure 10. FIG. 3 illustrates another application of the doctor arrangement according to the invention, where the mounting piece 13 is part of the blade holder 11. In other words, the form locking exists between the blade holder 11 and the beam structure 10. This application is especially suited for doctor arrangements which are loaded using a small load and where winding is not used. Here, the profile piece 18 is asymmetric so that loading can be directed preferably, and a short blade holder can be used. The doctor arrangement can also comprise loading elements 28, for which there are reservations 30 in the profile piece 18. In this way, the position of the blade holder with respect to the beam structure 10 can be changed so that the blade 12 can be loaded against the surface.

Both the mounting piece 13 and the profile piece 18 can be manufactured preferably using the pultrusion method so that each final part has accurate dimensions and shape without machining. This speeds up manufacture further, and entire work stages, such as adjustment machining, can be avoided completely. Furthermore, parts can be glued and wound without distortions, which expedites manufacture. Beam structures with highly varying sizes can be manufactured from the parts according to the invention. In practice, the diameter of the beam structure 10 is approx. 150-650 mm.

The floating mounting according to the invention accomplishes an easily adjustable and serviceable doctor arrangement. Despite its versatility, the doctor arrangement is easier to manufacture than before. Nevertheless, the properties of the doctor arrangement are better than before. In addition to the mounting piece 13, the profile piece 18 can be even manufactured by the meter. Slightly different parts can be manufactured with small mold changes. Engineering can be used for achieving certain general parts, from which doctor arrangements suitable for most applications can be manufactured. Integrating form-locking in the blade holder 11 gives further functional and cost benefits over prior art solutions. Friction between the parts can be reduced by using suitable material combinations or various coatings. Lubrication can also be used. Oscillation of the doctor arrangement can hence be carried out, for example, by simply moving the blade holder 11.

FIGS. 1*a* and 1*b*, for example, illustrate additional parts included in the doctor arrangement, which can be installed in the desired locations as necessary. The additional parts in the figures are finger guards 31, which also have form locking. They can hence be changed quickly. The finger guards 31 include an adapter 32, which is preferably glued, for example, to the beam structure 10 or to the blade holder 11. After this, a guard profile 33, which is preferably made of plastic, is pushed into the adapter 32. Its shape and size can hence be changed easily at the installation site using simple tools. Finger guards were earlier made of thin metal sheet, which was fastened to the beam structure with screws.

We claim:

1. A doctor and doctor support in a web forming machine or web handling machine, comprising:

a beam structure of composite material in the shape of a basic tube and which extends in a longitudinal direction;

a doctor blade extending in the longitudinal direction and in a lateral direction;

a profile piece formed of plastic or composite material having two side parts and a middle part therebetween, wherein the two side parts are sufficiently flexible so as to engage tubes of various selected diameters and are fitted over and fastened to the basis tube;

a first form-locked mounting counterpiece formed by the middle part of the profile piece;

a mounting piece, having a first edge fitted movably in the axial direction and fixed in the lateral direction of the blade to the beam structure by the first form-locked mounting counterpiece; and a blade holder, wherein the doctor blade is mounted to the blade holder, and the blade holder is mounted to the mounting piece.

2. The doctor and doctor support of claim 1 wherein the profile piece is glued on the beam structure and a coating layer made of a composite material is wound about the beam structure and the profile piece.

3. The doctor and doctor support of claim 1, wherein the mounting piece is made of a material different from the material of the beam structure.

4. The doctor and doctor support of claim 1 wherein the profile piece is a structure of constant profile.

5. The doctor and doctor support of claim 1, wherein the basic tube and the profile piece define an empty space therebetween, and wherein at least two medium connections are arranged in said empty space.

6. The doctor and doctor support of claim 1 wherein the blade holder has portions forming a second form-locked mounting counterpiece and is fitted movably in the axial direction and fixed in the lateral direction of the blade to a second edge of the mounting piece, wherein the doctor blade is mounted to the blade holder.

7. The doctor and doctor support of claim 6, wherein the mounting piece has a plate-like shape and two longitudinal edges which correspond to the first form-locked mounting counterpiece and the second form-locked mounting counterpiece.

8. The doctor and doctor support of claim 7 wherein the mounting piece plate-like shape has at least one fold, and wherein the fold extends in the longitudinal direction of the blade.

9. The doctor and doctor support of claim 7 further comprising a loading hose positioned between the first form-locked mounting counterpiece and the first edge of the mounting piece to lock the mounting piece with respect to the beam structure.

10. A doctor and doctor support in a web forming machine or web handling machine, comprising:

a fiber reinforced plastic tube of a selected diameter forming a beam structure extending in a longitudinal direction;

a first pultrusion glued to the beam structure, having two side parts and a middle part therebetween, wherein the two side parts are sufficiently flexible so as to engage tubes of various selected diameters, and the two side parts are fitted over and fastened to the fiber reinforced plastic tube and wherein the middle part of the first pultrusion forms a first form-locked mounting counterpiece;

a second pultrusion forming a mounting piece fitted movably in the axial direction to the beam structure by the first form-locked mounting counterpiece;

a blade holder having portions forming a second form-locked mounting counterpiece which fastens movably in the axial direction to the second pultrusion; and a blade extending in the longitudinal direction and in a lateral direction and fastened to the blade holder.

11. The doctor and doctor support of claim 10 further comprising a coating layer made of a composite material which is wound about the beam structure and the profile piece, wherein the coating layer has portions defining a machined slot, which slot extends in to the portions forming the first form-locked mounting counterpiece.

12. The doctor and doctor support of claim 10 wherein the mounting piece has a plate-like shape and two longitudinal edges which correspond to the first and second form-locked mounting counterpieces.

13. The doctor and doctor support of claim 12, wherein there is at least one fold in the mounting piece plate-like shape, and wherein the fold extends in the longitudinal direction of the blade.

14. The doctor and doctor support of claim 10, wherein the first pultrusion and the beam structure define an empty space therebetween, and wherein at least two medium connections are arranged in said empty space.

15. The doctor and doctor support of claim 10 further comprising a loading hose positioned between the first form-locked mounting counterpiece and the mounting piece to lock the mounting piece with respect to the beam structure.

16. A doctor and doctor support in a web forming machine or web handling machine, comprising:

a fiber reinforced plastic tube forming a beam structure extending in a longitudinal direction;

a profile piece having two side parts and a middle part therebetween and wherein the two side parts are sufficiently flexible so as to engage tubes of various selected diameters, and the two side parts are fitted over and glued to the plastic tube beam structure, and the middle part forming a first form-locked mounting counterpiece;

a blade holder having portions which engage the first form-locked mounting counterpiece of the profile piece to fasten the blade holder movably in the axial direction to the beam structure; and a blade extending in the longitudinal direction and in a lateral direction and fastened to the blade holder.

17. The doctor and doctor support of claim 16 wherein the profile piece is asymmetric such that loading can be directed in a particular direction.

18. The doctor and doctor support of claim 16 further comprising a first loading hose mounded to a first reservation in the profile piece, and a second loading hose mounted to a second reservation, and wherein the blade holder is positioned therebetween and engaged by the first loading hose and the second loading hose.

* * * * *